US006060171A

United States Patent [19]

Greenblat et al.

[11] Patent Number: 6,060,171

[45] Date of Patent: May 9, 2000

[54] ACHIEVEMENT PLAQUE AND METHOD OF MAKING SAME

[75] Inventors: Alan P. Greenblat, Diamond Bar; John Banman, Brea, both of Calif.

[73] Assignee: Plastic Dress-Up Co., South El Monte, Calif.

[21] Appl. No.: 09/187,010

[22] Filed: Nov. 4, 1998

Related U.S. Application Data

[63] Continuation-in-part of application No. 08/703,019, Aug. 26, 1996, Pat. No. 5,834,073.

[51] Int. Cl.[7] ..... A47G 35/00

[52] U.S. Cl. ..... 428/542.2; 428/13; 428/15; 428/33; 428/210; 428/542.4; 428/913.3

[58] Field of Search ..... 428/210, 13, 542.2, 428/542.4, 33, 913.3, 15; 264/259; 425/547, 127

[56] References Cited

U.S. PATENT DOCUMENTS

| | | | |
|---|---|---|---|
| 3,879,874 | 4/1975 | Broussard | 428/542.4 X |
| 4,307,527 | 12/1981 | Suzuki | 264/259 X |
| 4,546,019 | 10/1985 | Schneider | 428/13 |
| 4,881,884 | 11/1989 | De'Ath | 425/127 X |
| 5,419,940 | 5/1995 | Wood et al. | 428/13 |
| 5,433,980 | 7/1995 | Auld et al. | 428/13 |
| 5,834,073 | 11/1998 | Greenblat et al. | 428/13 |

*Primary Examiner*—Deborah Jones
*Assistant Examiner*—Abraham Bahta
*Attorney, Agent, or Firm*—James E. Brunton

[57] ABSTRACT

An achievement award including a novel, substantially transparent, injection molded acrylic or other plastic plaque and a supporting base therefor. The display plaque is provided with ornamental designs comprising either or both a fossil-like, three-dimensional decorative design or image which appears to be embedded in the central body portion of the plaque and an upstanding ornamental design which extends outwardly from the front face of the plaque. The display plaque uniquely includes strategically located bevels that give the plaque the appearance of expensive cut glass and, at the same time, functions to optically mask the mold lines which are formed during the injection molding process. The mold of the invention for use in injection molding the plaque with the fossil-like design includes several different types of mold inserts that can be positioned within the mold cavity so as to produce fossil-like designs within the body of the plaque of various shapes such as the shape of a golfer, a bowler, a basketball player and other types of athletic figures.

15 Claims, 6 Drawing Sheets

FIG. 5
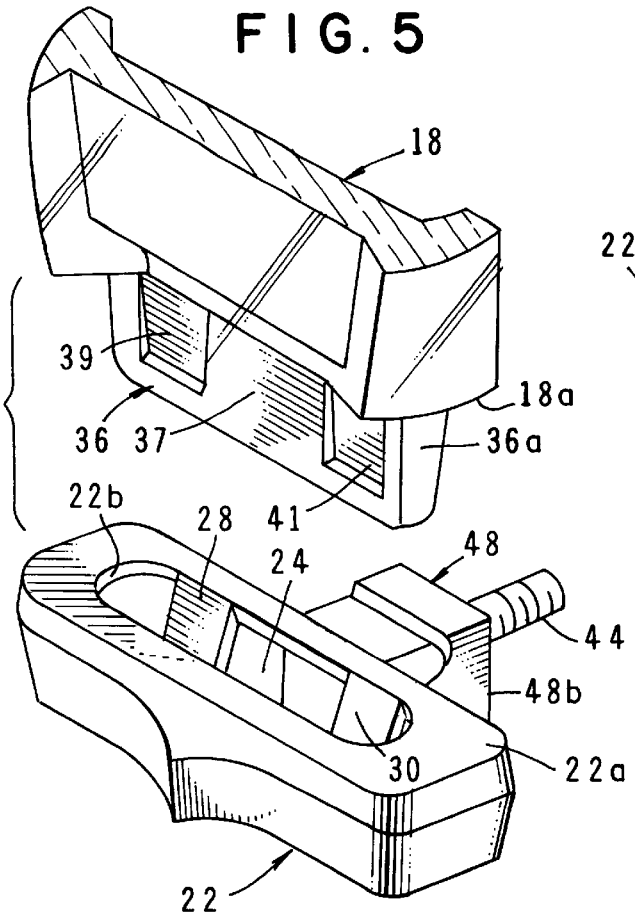
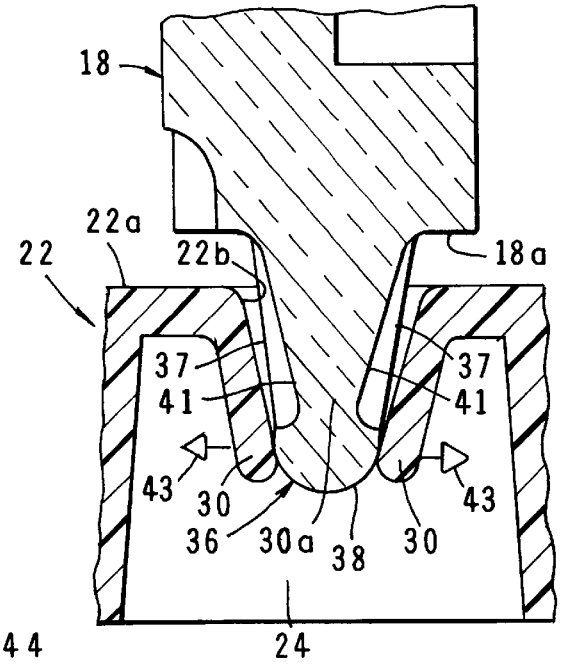
FIG. 6
FIG. 7
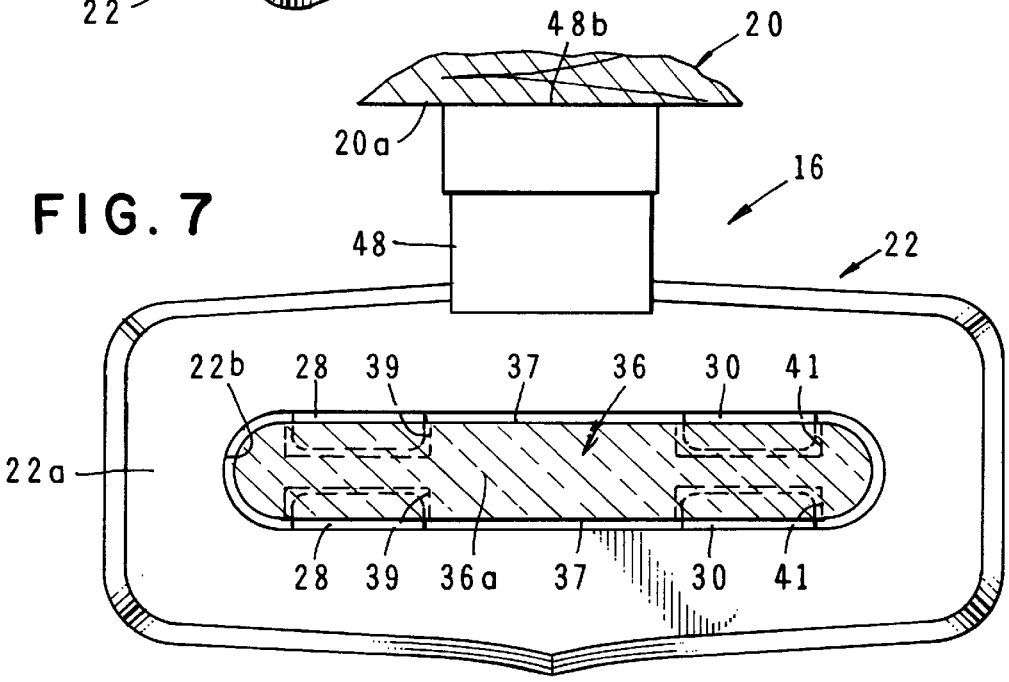

ACHIEVEMENT PLAQUE AND METHOD OF MAKING SAME

This is a Continuation-In-Part application of U.S. application, Ser. No. 08/703,019 filed Aug. 26, 1996, now U.S. Pat. No. 5,834,073.

BACKGROUND OF THE INVENTION

1. Field of the Invention

The present invention relates generally to achievement awards. More particularly, the invention concerns a novel award plaque and the method of mounting the same on bases of various configurations.

2. Discussion of the Invention

Achievement awards of various types are frequently given to individuals and athletic teams for outstanding achievements in sports such as golf, bowling, tennis, baseball, basketball and the like. These awards include medals, small statues and a number of different types of plaques which frequently take the form of inscribed commemorative tablets.

A very popular type of commemorative tablet or plaque is a plaque constructed from a clear acrylic tablet which is suitably mounted in a vertical orientation on a wooden, marble, or like material base. In many instances a decorative design is carried by the plaque in a manner such that it can be seen when viewing the front of the plaque. When the plaque is mounted in a vertical orientation on a suitable base, the design is readily viewable making the finished article attractive and quite suitable as an award for scholastic or other athletic achievement.

In the prior art the aforementioned types of plaques or tablets are typically affixed to a suitable supporting base by solvent welding or through the use of clips, screws or other types of mechanical fastening means. Exemplary of such a construction is that shown and described in U.S. Pat. No. 5,419,940 issued to Wood et al.

Another novel means for affixing a plaque or tablet to a supporting base is described in U.S. Ser. No. 08/703,019 filed by the present inventor. Because the present invention comprises an improvement upon the inventions described in this latter application, U.S. Ser. No. 08/703,019 is incorporated by reference as though fully set forth herein.

As will become apparent from the description which follows, the achievement plaques of the present invention can be uniquely mounted on bases and support structures of various configurations through the use of a novel connector tang which can be integrally formed with the award plaque or, alternatively, can be formed as a separate unit and then fixedly connected to the award plaque by suitable means.

By using the novel interconnecting means or connector tangs of the invention, the finished products of the present invention can be mass produced in a minimum time at relatively low cost and exhibit superior quality to those made by traditional prior art processes.

SUMMARY OF THE INVENTION

It is an object of the present invention to provide a novel, attractive and inexpensive achievement award which includes a display plaque, a supporting base and novel means for interconnecting the display plaque with the supporting base.

More particularly, it is an object of the present invention to provide a novel, achievement award of the aforementioned character in which the means for interconnecting the display plaque with its supporting base can be integrally formed with the display plaque or alternatively can be separately formed and then adhesively bonded to the display plaque.

Another object of the invention to provide an achievement award of the character described in the preceding paragraphs in which the connecting means can be used to readily connect the display plaque to the bases of widely differing configurations.

Another object of the invention is to provide an award plaque of the aforementioned character which enables the high volume, low cost production of extremely versatile, lightweight and highly attractive achievement awards that are markedly superior in construction and durability to similar plaques made by traditional, prior art processes.

Another object of the invention is to provide an award plaque of the character described which is simple to make, is easy to assembly and is pleasing in appearance.

BRIEF DESCRIPTION OF THE DRAWINGS

FIG. 5 is an enlarged, generally perspective, exploded view of the display plaque of achievement award of the invention and the connector means for interconnecting the display plaque with the wall-mounted support member.

FIG. 6 is an enlarged, fragmentary, cross-sectional view illustrating the manner of interconnection of the display plaque of the invention with the connector means shown in FIG. 5.

FIG. 7 is an enlarged, cross-sectional view taken along lines 7—7 of FIG. 2.

DESCRIPTION OF THE INVENTION

Figure 1:
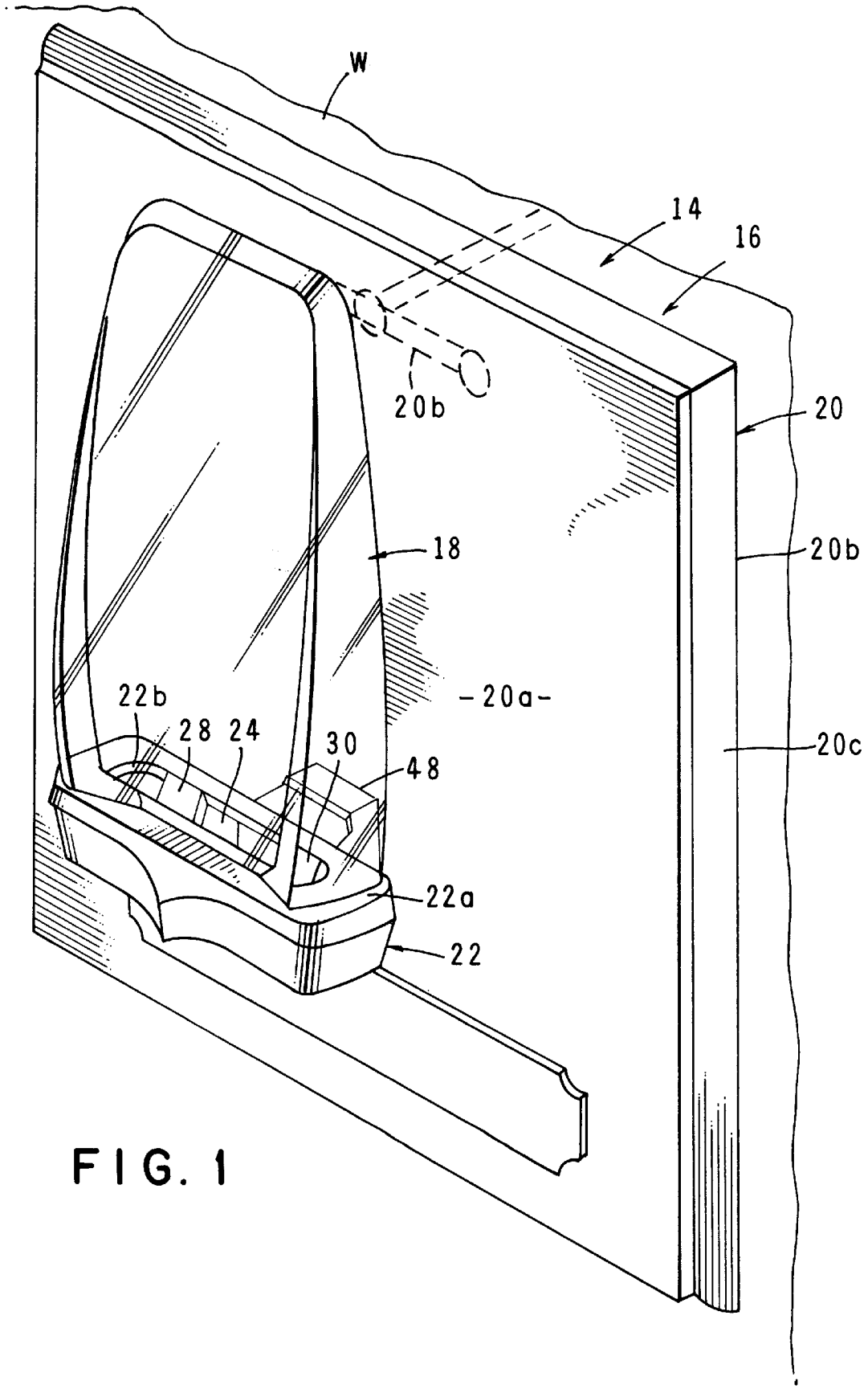
FIG. 1 is a generally perspective view of one form of the achievement award of the invention showing the display plaque portion of the award mounted in a spaced-apart, generally parallel relationship with a wall-mounted support member.
Figure 2:
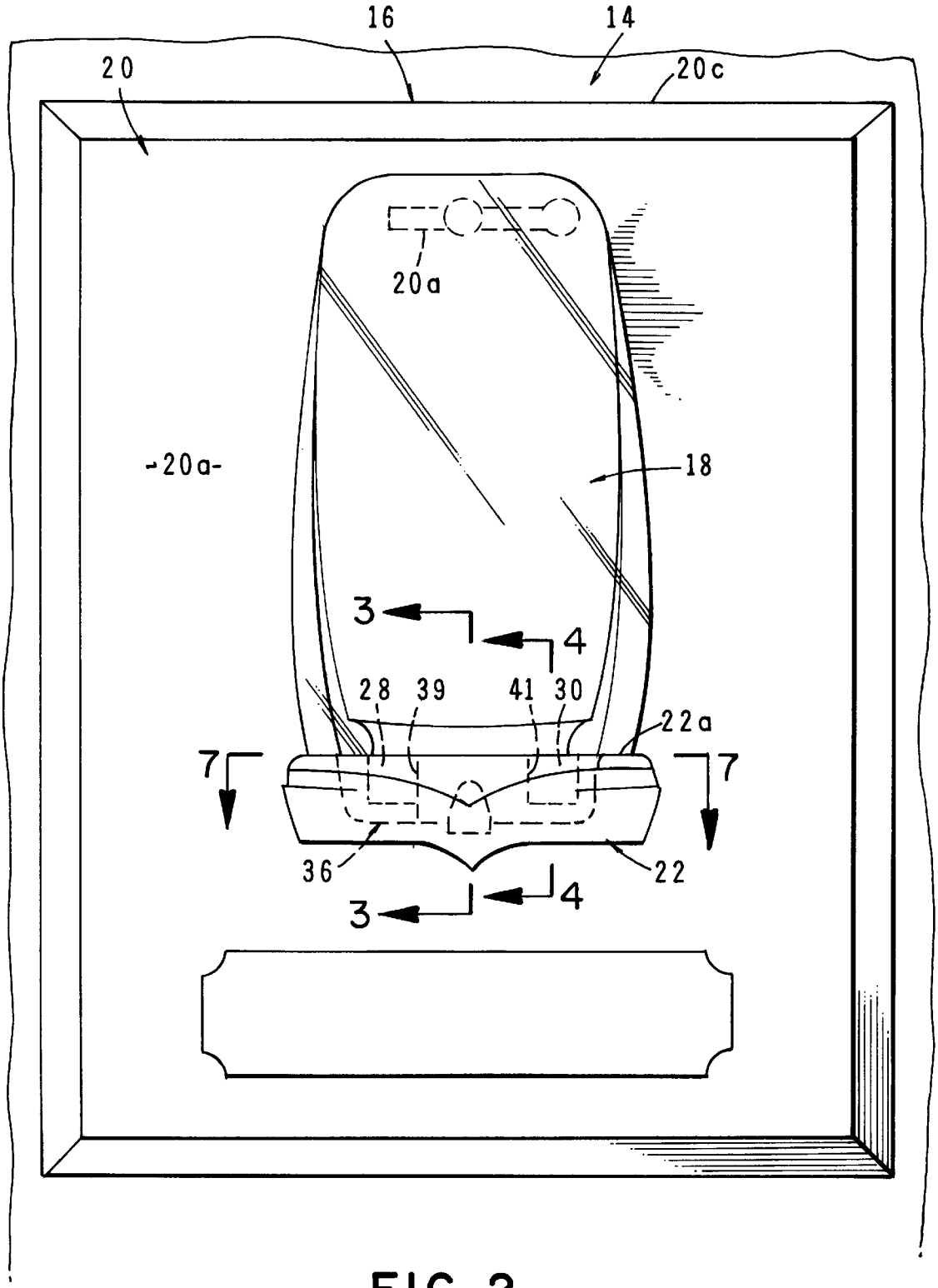
FIG. 2 is front view of the achievement award shown in FIG. 1.

Referring to the drawings and particularly to FIGS. 1 through 7, one form of the achievement award of the present invention is there illustrated and generally designated by the numeral 14. The award here comprises a support assembly 16 and an injection-molded, substantially transparent, injection molded acrylic plaque 18 which is connected to support assembly 16 by a novel connector means, the character of which will presently be described.

Figure 3:
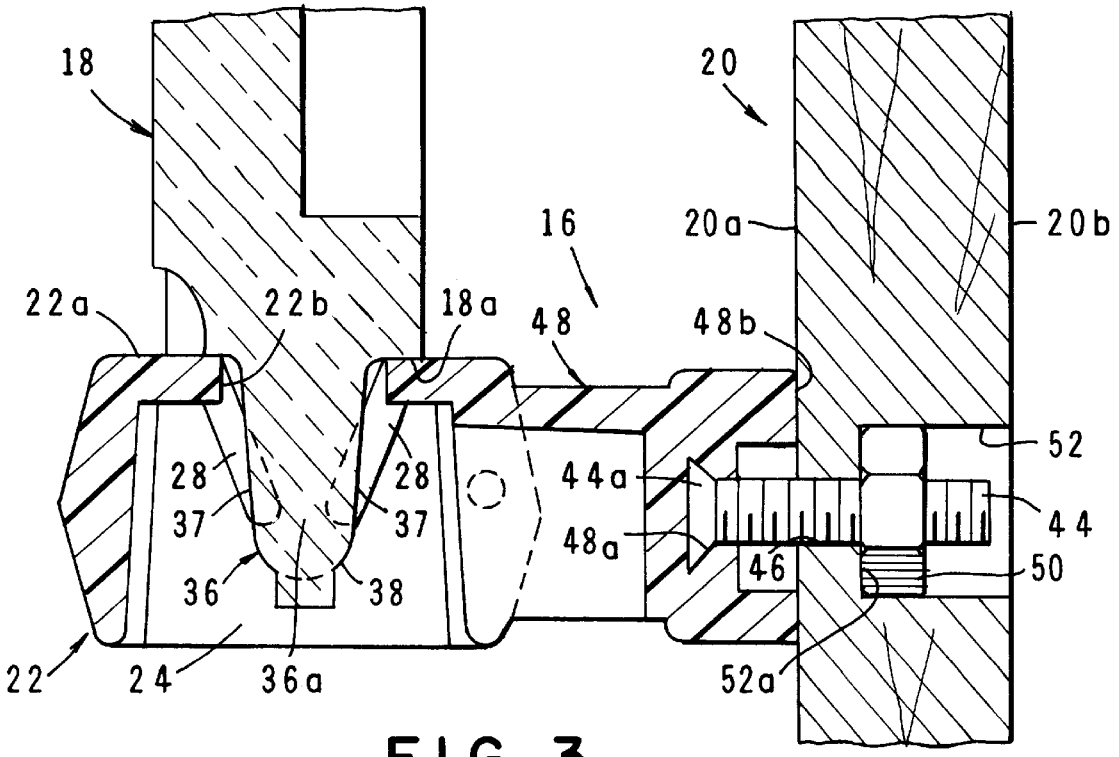
FIG. 3 is an enlarged, cross-sectional view taken along lines 3—3 of FIG. 2.
Figure 4:
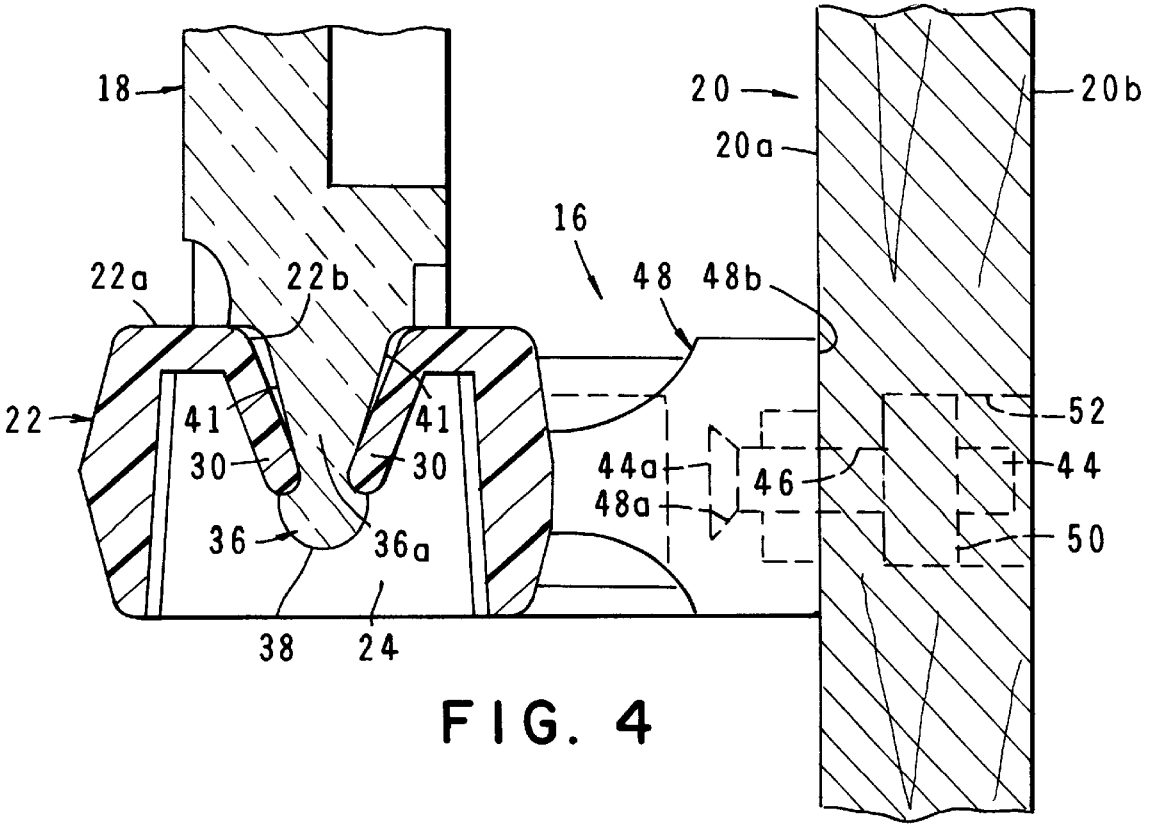
FIG. 4 is an enlarged, cross-sectional taken along lines 4—4 of FIG. 2.

As best seen in FIGS. 1 and 3, support assembly 16 here comprises a generally planar, wall-mounted member 20 and a hollow body portion 22.

Member 20 has a front face 20*a*, a rear face 20*b* and a circumscribing edge portion 20*c*. Body 22 has an interior chamber 24 and further includes an upper wall 22*a* which has an elongated, oval shaped opening 22*a* formed therein (FIG. 5). Extending downwardly from upper wall 22*a* into chamber 24 are first and second resiliently deformable pairs of tabs 28 and 30 (FIG. 7). As will presently be described, these tabs, which comprise the locking means of the invention, function to lockably interconnect display plaque 18 with body 22 of the support assembly 16.

Forming an important aspect of the apparatus of the present invention is connector means for interconnecting display plaque 18 with support assembly 16. In the present form of the invention, this connector means comprises an elongated, strategically shaped connector tang 36 which is connected to a base wall 18*a* of display plaque 18. In the form of the invention shown in FIGS. 1 through 7, connector tang 36 is integrally formed with display plaque 18. However, in a second form of the invention, which is illustrated in FIGS. 8 through 11, the connector tang 36 is formed as a separate element which can be connected to base portion 18*a* of display plaque 18 by any suitable means such as solvent welding or adhesive bonding.

As best seen by referring to FIGS. 3 through 6, connector tang 36 is of a unique construction having a body portion 36*a* which includes angularly extending opposing side walls 37. At their upper margins, walls 37 engage base wall 18*a* of plaque 18. At their lower margins, walls 37 join with curved bottom surface 38 of the connector. Formed in walls 37 are first and second spaced-apart pairs of cavities 39 and 41 respectively. As best seen by referring to FIG. 7, when display plaque 18 is mated with body portion 22, connector tang 36 extends downwardly into chamber 24 with the first pair of resilient tabs 28 being closely received within cavities 39 of the connector tang 36 and second pair of tabs 30 being closely received within second cavities 41. The connector tabs and cavities that closely receive them are strategically designed so that once the display plaque 18 is fully inserted into chamber 24, the resiliently deformable connector tabs will lock the plaque against removal. As can be seen by referring to FIG. 6, as the assemblage made up of the award plaque and the connector tang 36 which is affixed thereto is urged downwardly into cavity 24 of body 22, the resiliently deformable tabs 28 and 30 will yieldably deform outwardly in the direction of the arrows 43 of FIG. 6 allowing the lower portion of connector tang 36 to pass into chamber 24. Once the connector tang is fully inserted into chamber 24, the resiliently deformable tabs will spring back to their original position where they will be lockably received within the cavities 39 and 41 formed in connector tab 36. With the connector tabs received within the spaced apart cavities in the manner shown in FIG. 4, removal of the connector tang from body 22 will be positively prevented.

In the form of the invention shown in FIGS. 1 through 7, means are provided for connecting body 22 of the support assembly to the wall mounted, generally planar support member 20. This means here comprises a threaded connector 44 which is receivable through a drilled bore 46 formed in support member 20 (FIG. 3). Threaded connector 44 has a head portion 44*a* which is receivable within a cavity 48*a* formed in a connector stub 48 which is preferably integrally formed with hollow body 22. Connector stub 48 includes, in addition to cavity 48, an end wall 48*b* which is drawn into pressural engagement with surface 20*a* of support 20 when a nut 50 is threadably received over the threaded shank portion of connector 44 in the manner shown in FIG. 3. By cinching nut 50 down against the inner wall 52*a* of a counter bore 52 provided in support member 20, wall 48*b* of connector stub 48 will be drawn into secure engagement with surface 20*a* of member 20 thereby supporting body 22 in the cantilever configuration shown in FIGS. 3 and 4. With this construction, when display plaque 18 is interconnected with hollow body 22 in the manner shown in FIGS. 3 and 4, display plaque 18 will be disposed in an attractive spaced-apart, generally parallel relationship with surface 20*a* of support member 20 (see also FIG. 1).

As indicated in FIG. 1, rear surface 20*b* of support 20 is provided with means for mounting the support on a vertical surface such as a vertical wall "W". This means here comprises a screw head receiving channel 20*d* formed in rear surface 20*b*.

Body portion 22 and subconnector 44 can be constructed from any type of moldable plastic and support member 20 can be constructed from wood, plastic, metal or other suitable material.

Figure 8:
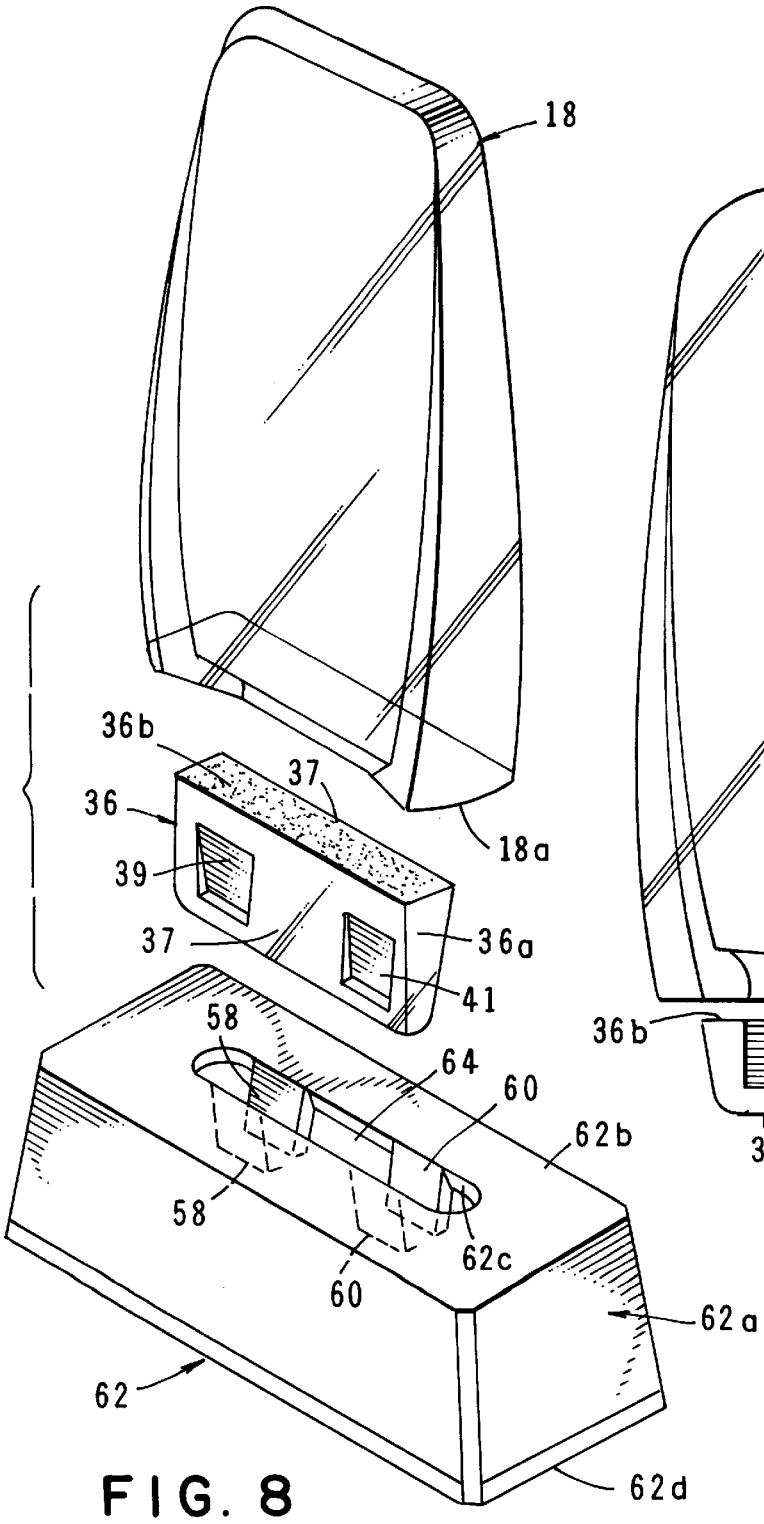
FIG. 8 is a generally perspective, exploded view of an alternate form of the achievement award of the invention in which the connector tang of the connector means is formed separately from the display plaque and in which the display plaque is connected to a differently configured support using the connector tangs.
Figure 9:
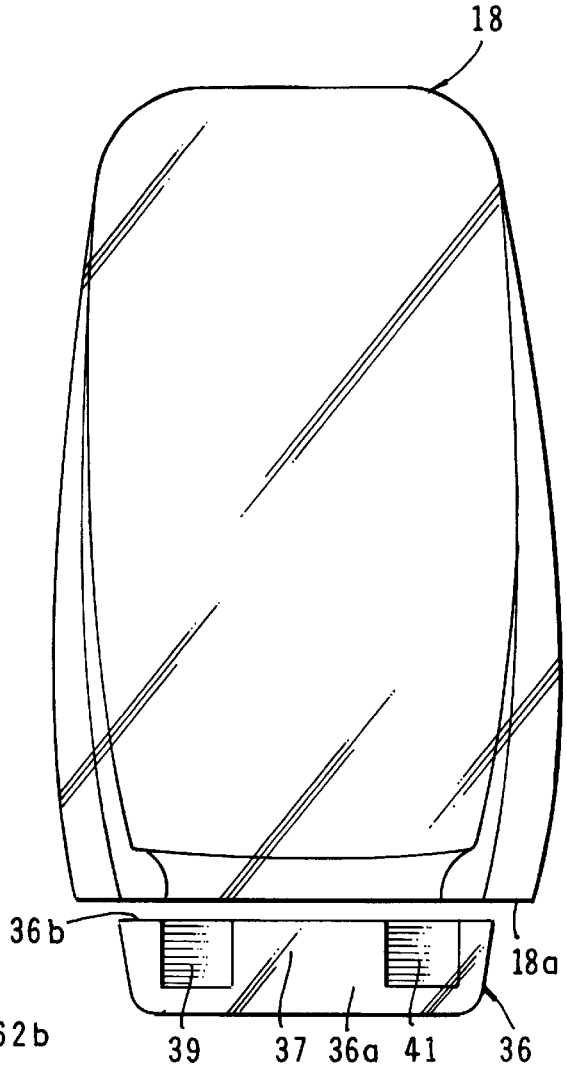
FIG. 9 is a front view of the display plaque and connector tang shown in FIG. 8.

Turning next to FIGS. 8 through 11, an alternate form of the achievement award of the present invention is there illustrated. This achievement award is similar in many respects to that illustrated in FIGS. 1 through 7 and like numerals are used in FIGS. 8 through 11 to identify like components. As previously mentioned, one difference between the embodiment of the invention shown in FIGS. 1 through 7 and this latter form of the invention resides in the fact that the connector means or connector tang 36 of the invention is formed as a separate component from the display plaque 18. More particularly, as is best seen in FIG. 8, connector tang 18, as before, includes a body portion 36*a* having angularly extending side walls 37 which join at their upper margins with a generally planar base wall 36*b*. As earlier described, walls 37 are provided with first and second pairs of cavities 39 and 41 which are adapted to closely receive first and second pairs of resiliently deformable tabs 58 and 60 which comprise a part of the support assembly 62 of this latest form of the invention. Support assembly 62 includes a desk-mounted, weighted body 62*a* having an interior chamber 64 (FIG. 11), a top wall 62*b* which is provided with an elongated, generally oval shaped opening 62*c* (FIG. 8) and a bottom surface engaging wall 62*d*.

Figure 10:
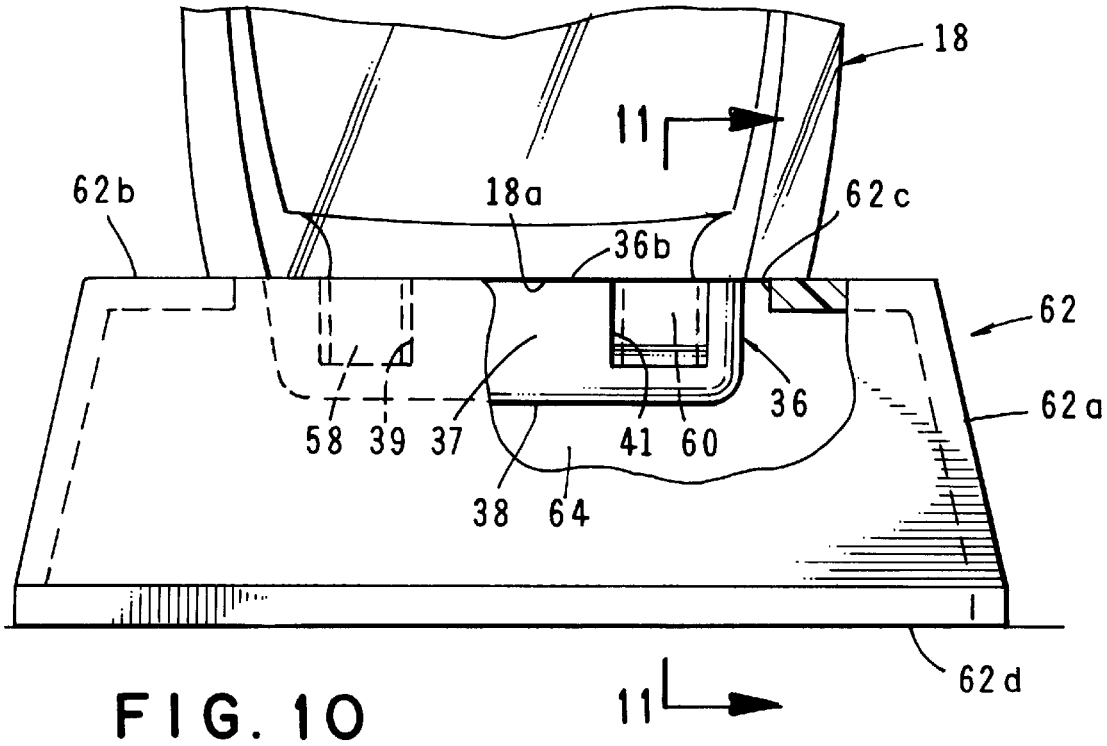
FIG. 10 is an enlarged, fragmentary front view of the construction depicted in FIG. 8, but shown in an assembled configuration with the connector tang connected to the display plaque and with the assemblage thus formed connected to the supporting base.
Figure 11:
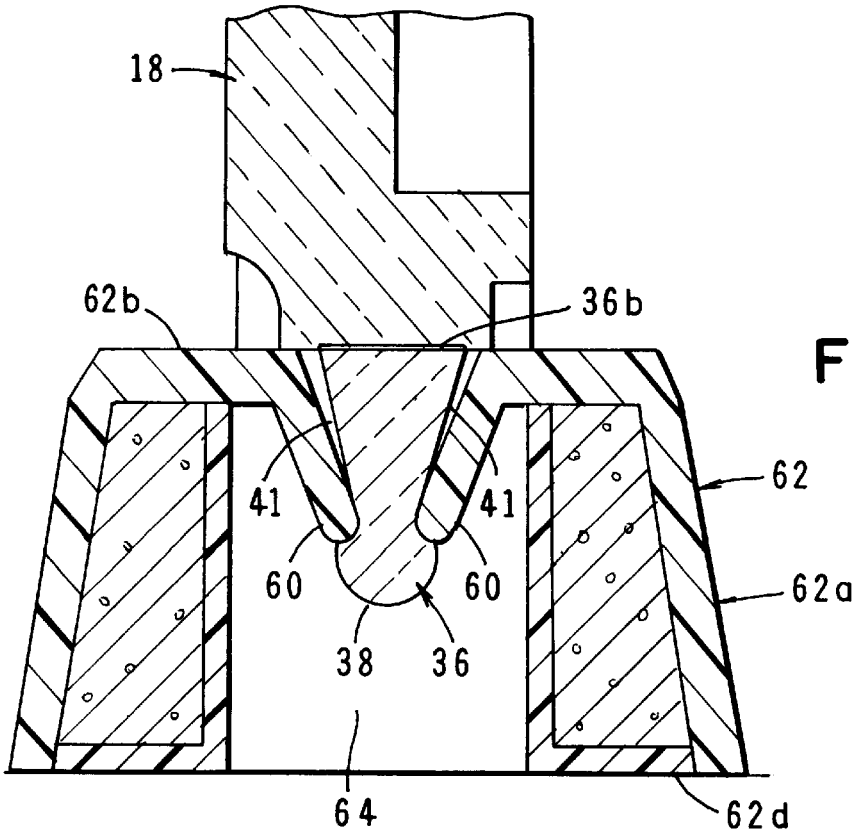
FIG. 11 is an enlarged, cross-sectional view taken along lines 11—11 of FIG. 10.

When connector tang 36 is interconnected with plaque 18 by any suitable bonding means such as solvent welding, the assemblage thus formed can be mated with support assembly 62 in the manner shown in FIG. 10 and 11. As was the case with the earlier described embodiment of the invention, as the plaque and tang assembly is inserted into cavity 64, pairs of tabs 58 and 60 will deform outwardly to allow passage of the tang body to a position wherein pairs of resiliently deformable tabs 58 and 60 will spring back into locking engagement with pairs of cavities 39 and 41 formed in connector tang 36. As before, once tabs 58 and 60 are lockable received within cavities 39 and 41 in the manner shown in FIG. 11, the display plaque and connector tang assemblage cannot be removed from support assembly 62.

With the construction illustrated in FIGS. 8 through 11, it is apparent that connector tang 36 can be affixed to display plaques of various configurations so that the display plaques can be interconnected with a variety of support assemblies such as the support assembly 16 of FIGS. 1 through 7 and the support assembly 62 of FIGS. 8 through 11. With the novel construction thus described, a wide variety of support configurations can be used to support a wide variety of configurations of display plaques through use of the novel connector means or connector tab 36 of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. An achievement award comprising:

(a) a support assembly including a body having an interior chamber, said body including:
  (i) an upper wall having an opening therein; and
  (ii) a first pair of resiliently deformable tabs extending downwardly from said upper wall into said chamber;

(b) a display plaque connected to said support assembly, said display plaque including a base portion; and (c) connector means for connecting said display plaque to said support assembly, said connector means comprising a connector tang connected to said base portion of said display plaque, said connector tang comprising a body portion having a first pair of cavities for receiving said first pair of tabs of said body of said support assembly.

2. The achievement award as defined in claim 1 in which said support assembly further comprises:

(a) a generally planar support; and (b) means for connecting said body of support assembly to said generally planar support to position said display plaque in a generally parallel relationship with said generally planar support when said display plaque is connected to said support assembly.

3. The achievement award as defined in claim 2 in which said means for connecting said body of said support assembly to said generally planar support comprises a threaded connector.

4. The achievement award as defined in claim 2 in which said generally planar support includes a generally planar rear wall, said rear wall having means for connecting said generally planar support to a vertically extending surface.

5. The achievement award as defined in claim 2 in which said body portion of said connector tang comprises a generally planar base wall and a pair of side walls extending angularly from said generally planar base wall, said spaced apart cavities being formed in said side walls.

6. The achievement award as defined in claim 4 in which said body portion of said support assembly includes a second pair of resiliently deformable tabs extending downwardly from said upper wall and in which said body portion of said connector tang further includes a second pair of spaced-apart cavities for receiving said second pair of tabs.

7. An achievement award comprising:

(a) a support assembly comprising a generally planar, wall-mounted support and a body connected to said generally planar support, said body having an interior chamber, and including:
  (i) an upper wall having an opening therein; and
  (ii) a first pair of resiliently deformable tabs extending downwardly from said upper wall into said chamber;

(b) a display plaque connected to said support assembly, said display plaque including a base portion; and (c) connector means for connecting said display plaque to said support assembly, said connector means comprising a connector tang connected to said base portion of said display plaque, said connector tang comprising a body portion having a first pair of cavities for receiving said first pair of tabs of said body of said support assembly.

8. The achievement award as defined in claim 7 in which said support assembly further comprises means for connecting said body of support assembly to said generally planar support to position said display plaque in a spaced-apart, generally parallel relationship with said generally planar support when said display plaque is connected to said support assembly.

9. The achievement award as defined in claim 8 in which said wall-mounted planar support is provided with a bore therethrough and in which said means for connecting said body of said support assembly to said generally planar support comprises a threaded connector extending through said bore.

10. The achievement award as defined in claim 9 in which said body portion of said support assembly includes a second pair of resiliently deformable tabs extending downwardly from said upper wall and in which said body portion of said connector tang further includes a second pair of spaced-apart cavities for receiving said second pair of tabs.

11. The achievement award as defined in claim 10 in which said body portion of said connector tang comprises a generally planar base wall and a pair of side walls extending angularly outward from said generally planar base wall, said spaced apart cavities being formed in said side walls.

12. An achievement award comprising:

(a) a support assembly comprising a generally planar, wall-mounted support and a body connected to said generally planar support, said body having an interior chamber, said body further including:
  (i) an upper wall having an opening therein; and
  (ii) first and second pairs of resiliently deformable tabs extending downwardly from said upper wall into said chamber;

(b) a display plaque connected to said body portion of said support assembly and disposed in a generally parallel, spaced-apart relationship relative to said wall-mounted support; and (c) connector means for connecting said display plaque to said support assembly, said connector means comprising a connector tang connected to said base portion of said display plaque, said connector tang comprising a body portion having first and second pairs of cavities for receiving said first and second pairs of tabs of said body of said support assembly.

13. The achievement award as defined in claim 12 in which said wall-mounted planar support is provided with a bore therethrough and in which said means for connecting said body of said support assembly to said generally planar support comprises a threaded connector extending through said bore.

14. The achievement award as defined in claim 13 in which said body portion of said connector tang comprises a generally planar base wall and a pair of side walls extending angularly relative to said generally planar base wall, said spaced apart cavities being formed in said side walls.

15. The achievement award as defined in claim 14 in which said connector tang is integrally formed with said display plaque.

* * * * *